United States Patent [19]

De Donato

[11] 4,373,609

[45] Feb. 15, 1983

[54] STAIRWAY STRINGERS CONSTRUCTED OF CAST, READILY-ASSEMBLED UNITS

[76] Inventor: Victor De Donato, 30 LeMoyne Ave., Pittsburgh, Pa. 15228

[21] Appl. No.: 218,939

[22] Filed: Dec. 22, 1980

[51] Int. Cl.[3] ..... E04F 11/00

[52] U.S. Cl. ..... 182/178; 182/93; 182/194; 182/228; 52/187

[58] Field of Search ..... 182/194, 100, 189, 228, 182/178, 93; 52/182, 187, 188

[56] References Cited

U.S. PATENT DOCUMENTS 3,474,882 10/1969 Ernst ..... 52/182

4,125,175 11/1978 Ernst ..... 52/182

4,285,178 8/1981 Holzkampfer ..... 52/182

4,296,577 10/1981 Schuette ..... 52/187

*Primary Examiner*—Reinaldo P. Machado

*Attorney, Agent, or Firm*—T. A. Zalenski

[57] ABSTRACT

A stairway is constructed of one or more stringers which are assembled from a plurality of stringer units of cast material. The stringer units are so constructed as to allow for their simple and rapid assembly on-site into stringers of any desired size and configuration, including stringers of a configuration required for the construction of spiral stairways.

10 Claims, 4 Drawing Figures

STAIRWAY STRINGERS CONSTRUCTED OF CAST, READILY-ASSEMBLED UNITS

BACKGROUND OF THE INVENTION

1. Field of the Invention

The present invention relates to the art of stepped structures, i.e., structures having surfaces which are arranged in repetitions vertical and horizontal offset relationship. More specifically, the invention concerns the construction of stringers for supporting stairways, including spiral stairways, wherein the stringers are formed of a plurality of cast units which are readily assembled in a continuous, stepped relationship.

2. Description of the Prior Art

The erection of custom-made stairways, such as spiral staircases, using metal stringers has been a labor-intensive, tedious and expensive proposition. Typically such erection first involves the separate fabrication of the vertical and horizontal elements from which the stairway stringer is constructed. Using elaborate jigs, these elements are alternately joined together by welding to form a stringer. Only highly-skilled artisans are capable of performing this work with the precision that is required. Even those skilled in the art, however, require a substantial expenditure of their time to construct such stairways. Further, because of the need for special equipment and the lengthy time required to complete a job, it is not practical to perform the work on-site. The work is carried out at the artisan's shop, and those adjustments in the work which often are required because of the peculiar conditions at the site where the stairway is to be installed often do not become apparent until the stairway is put in place and such adjustments difficult to make. To an extent, the inventions disclosed in U.S. Pat. No. 3,474,882 overcome some of the prior art difficulties. That patent discloses constructing a staircase or the like from prefabricated structural elements comprising substantially Z-shaped double angles, each having a rigid central member and a pair of parallel tubular arms connected to said central member near the opposite ends thereof. The arms project in opposite directions from the central member and are adapted to be telescopically connected and secured to one of the tubular arms of another double-angle of the same type so as to form a stairway stringer. U.S. Pat. No. 4,125,175 discloses similar structural elements.

The present invention differs from and possesses several advantages over the structural elements disclosed in the two aforesaid patents. The present invention uses cast rather than prefabricated elements and, consequently, less labor is involved in the forming of the elements. Also the cast structure is more likely to be consistent and uniform from element to element than the prefabricated element which must be welded together whereby errors in alignment can be introduced. From a structural standpoint, rather than being a Z-shaped double angle, as are the elements disclosed in the two patents referred to above, the units of the present invention have both arms, which serve to connect the units to similar adjacent units, extending in the same direction. As a result, according to the present invention, the location where the arms of adjacent units are secured together falls below the adjacent stair plank, whereas the location where the arms of adjacent units are joined falls above the adjacent stair plank in U.S. Pat. Nos. 3,474,882 and 4,125,175.

SUMMARY OF THE INVENTION

In accordance with the present invention, a cast unit is provided such that a plurality of the units may be easily assembled in a continuous, stepped relationship to form a stringer for constructing a stairway. The unit comprises first and second arms and an intermediate member joining the two arms together. One end of each arm is integral with the intermediate member and the other end of each arm is free. The arms are substantially parallel and extend in the same direction and at substantially right angles from the intermediate member. When the units are in their final position for supporting a stairway, the arms are vertical and the intermediate member is horizontal.

The first arm of the unit is provided with a recessed section which is open at the end of the arm which is integral with the intermediate member. The recessed section snugly receives the free end of the second arm of the unit which is adjacent to it in a direction up the stairway. As a corollary, the second arm of each unit is adapted to be snugly inserted in the recessed section of the first arm of the unit which is adjacent to it in a direction down the stairway. Typically, the units made from a cast material such as steel, iron, aluminum, bronze, brass and plastic, and the free end of the second arm can be rotatively received within the recessed section of the first arm so that the units can be arranged into a spiral configuration to support a spiral stairway. In that event, a single stringer positioned centrally of the stairway can be employed.

Adjacent units are secured together at the location where the free end of a second arm is inserted within the recessed section of a first arm. A shoulder is provided in the recessed section in the first arm on which the free end of the second arm of an adjacent unit rests. The second arm can be open from its end integral with the intermediate member to its free end. In that case, the size of the opening in the second arm which is adjacent its free end is narrower than the remainder of the opening so as to form a shoulder within the second arm adjacent its free end. Adjacent units are then secured together by a stud threaded to the free end of the first arm and extending into the recess in the first arm and into the opening in the second arm beyond the shoulder therein and a nut which is threaded onto the stud so as to bear against the shoulder in the second arm and force the free end of the second arm into secure contact with the shoulder in the first arm.

Other details, objects and advantages of the invention will become apparent from the description set out below of a presently preferred embodiment thereof.

BRIEF DESCRIPTION OF THE DRAWING

The accompanying drawing shows a presently preferred embodiment of the invention in which.

DESCRIPTION OF A PREFERRED EMBODIMENT OF THE INVENTION

Figure 1:
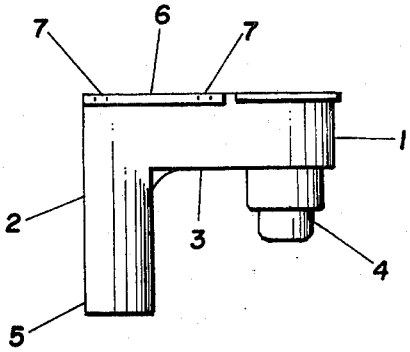
FIG. 1 is a side elevational view of a cast unit of the present invention, a plurality of which are assembled to form a stairway stringer.
Figure 2:
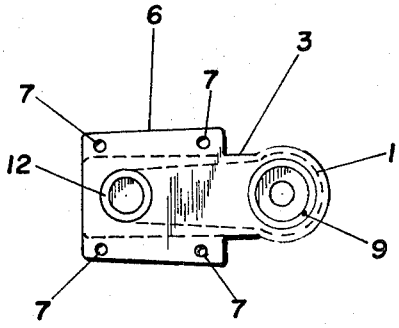
FIG. 2 is a top view of the cast unit of FIG. 1.

FIGS. 1 and 2 show the cast unit of the present invention. As will be described later, a plurality of these units are assembled into stringers for stairways.

The unit itself comprises a first arm 1 and a second arm 2 joined together by an intermediate member 3. As can be seen, one end of each of the arms 1 and 2 is integral with intermediate member 3. The arms are substantially parallel to one another and extend in the same direction and at substantially right angles from the intermediate member so as to form a free end 4 on arm 1 and a free end 5 on arm 2. The intermediate member 3 is flared outwardly along its sides to form a base 6 on which a stair plank is mounted, as will be described below. As shown, the base extends along the sides of the intermediate member 3 from a point between the two arms near arm 1 in the direction of arm 2 and to the end of the intermediate member. Holes are provided on each side of base 6 through which securing means, such as screws, may pass for the purpose of fastening a stair plank to the base 6. When a plurality of the cast units are assembled into a stringer for a stairway, the two arms 1 and 2 are in a vertical position and the intermediate member 3 and base 6 are arranged horizontally.

A significant aspect of the present invention is that the units are made of cast metal such as steel, iron, aluminum, bronze or brass or of a molded high-strength plastic. A cast unit has advantages over a unit fabricated from individual elements which are welded together. Dimensional uniformity is more likely with a cast unit. In addition, cast units may be more readily mass-produced than fabricated units.

The unit shown in FIGS. 1 and 2 is illustrated as having substantially plain lines. However, it can be appreciated that any desired form of ornamental design may be imparted to the unit for aesthetic purposes.

Figure 3:
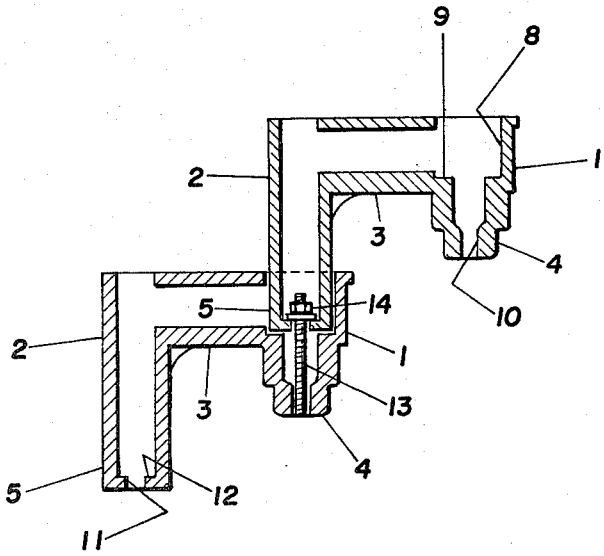
FIG. 3 is a vertical cross-sectional view of two cast units joined together in a manner to form a stairway stringer.

The internal construction of the unit and the manner in which units are assembled is shown in FIG. 3.

Arm 1 is provided with a recessed section 8 which is open at the end of arm 1 integral with intermediate member 3 for snugly receiving the free end 5 of arm 2 of an adjacent unit, as will be described. Recessed section 8 includes a shoulder 9 on which the free end 5 of arm 2 of an adjacent unit rests. At its free end 4, arm 1 is threaded, as is shown at 10, so that a bolt may be threadably fastened therein.

The free end 5 of arm 2 is adapted to be of a size and configuration so as to be able to be snugly inserted into the recessed section 8 of an adjacent unit. Arm 2 is open throughout its entire length from its end which is integral with the intermediate member 3 to its free end 5. The size of the opening 11 adjacent free end 5 is of a smaller diameter than the remainder of the opening so as to form a shoulder 12.

Recessed section 8 in arm 1 and free end 5 of arm 2 are machined so that when the units are assembled by inserting the free ends 5 of arms 2 into recessed sections 8 of adjacent units, a snug fit is provided between the respective free ends and recessed sections. When so assembled, the free end 5 of each arm 2 rests on the shoulder 9 provided in recessed section 8 of an adjacent unit.

The means for securely fastening together arms 1 and 2 of adjacent units comprise a first threaded member in the form of a stud 13 and a second threaded member, in the form of a nut 14, as shown in FIG. 3. Stud 13 is threaded into the free end 4 of arm 1 at 10 and extends up into recessed section 8 beyond shoulder 12 in the free end 5 of arm 2. Nut 14 is threaded onto stud 13 so as to bear against shoulder 12 and force the free end 5 of arm 2 into secure contact with shoulder 9. From the foregoing description, it can be seen that adjacent units are joined at a location which is below the immediately adjacent base 6 on which a stair plank is to be mounted.

As will now be understood, to form a stringer for constructing a stairway, a plurality of the cast units are assembled by successively inserting free ends 5 of arms 2 into recessed sections 8 of arms 1. The cast units when so assembled form a stringer having a continuous, stepped configuration, the horizontal surfaces of each of the steps being formed by base 6. Stair planks are secured to these bases to complete the construction of the stairway.

Figure 4:
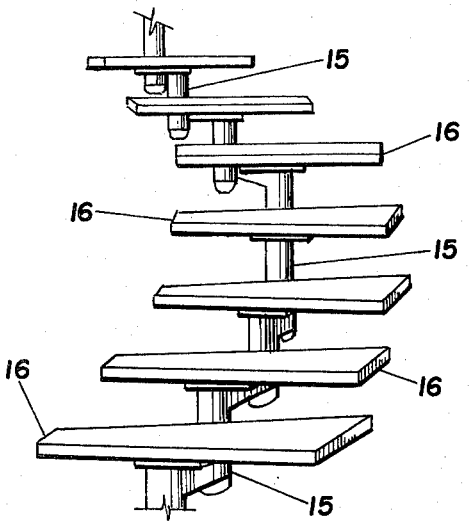
FIG. 4 is a perspective view illustrating the manner in which a plurality of the cast units of the present invention may be assembled to form a stringer for a spiral stairway.

In order to construct a spiral stairway as illustrated in FIG. 4, the free end 5 of arm 2 and the recessed section 8 of arm 1 of each of the cast units are fashioned so that each free end 5 is rotatably received within a respective recessed section of an adjacent unit. Consequently, in assembling the cast units into a stringer for a spiral stairway, rather than securing the units together in a straight line relationship as shown in FIG. 3, each successive unit is rotatably displaced by a desired amount from a straight line to form a spiral-shaped stringer as shown in FIG. 4 where the cast units are generally indicated at 15. Stair planks 16 are then secured to the bases 6 of the cast units so that the stringer is disposed centrally of the stairway. Those skilled in the art will be familiar with methods by which the stairway can finally be secured in place for service, and such methods are not described here. Also, it will be understood that handrailings or other auxiliary features may be included on such stairways. Spiral stairways of various radii can be constructed by varying the amount of displacement between adjacent units or by providing units where the distance between the two arms of each unit varies.

From the foregoing, it can be seen that the present invention provides for the rapid assembly of stringers for stairways. The present invention overcomes the costly and time-consuming method of assembling stringers by first fabricating vertical and horizontal elements which are alternately joined together by welding using elaborate jigs. The present invention allows stairways to be constructed on-site with great precision and avoids the necessity of assembling stairways where special equipment needed for their construction is located. By making the units of the present invention in the form of a casting, many units which are dimensionally uniform can be manufactured quickly. This allows the cost of construction of stairways to be reduced and enables the stairways to be constructed by other than highly-skilled artisans. The cast structure of the units also allows stringers of high-strength to be constructed.

While a presently preferred embodiment of the invention has been shown and described, it is to be understood that the invention is not limited thereto but can be otherwise variously embodied within the scope of the following claims.

I claim:

1. A readily-assembled stringer for constructing a stairway wherein the stringer is formed of a plurality of cast units assembled in a continuous, stepped relationship, each unit comprised of first and second arms and an intermediate member, each of said arms having an end integral with the intermediate member and a free end, said arms being substantially parallel and extending in the same direction and at substantially right angles from the intermediate member, said first arm having a recessed section open at the end of the arm integral with the intermediate member for snugly receiving the free end of the second arm of a first adjacent unit, said free end of the second arm being adapted to be snugly inserted in the recessed section of the first arm of a second adjacent unit, and means for securely fastening together the first and second arms of adjacent units.

2. Stringers formed of units as defined in claim 1 wherein the units are made of a cast material selected from the group consisting of steel, iron, aluminum, bronze, brass and plastic.

3. Stringers formed of units as defined in claim 1, wherein the free end of the second arm is rotatably received within the recessed section of the first arm of adjacent units and the units arranged into a spiral configuration to support a spiral stairway.

4. A stairway constructed of a single stringer as defined in claim 3 wherein the stringer is positioned centrally of the stairway.

5. Stringers formed of units as defined in claim 4 wherein the units are made of a cast material selected from the group consisting of steel, iron, aluminum, bronze, brass and plastic.

6. Stringers formed of units as defined in claim 1 wherein the recessed section in the first arm includes a shoulder on which the free end of the second arm of an adjacent unit rests.

7. Stringers formed of units as deferred in claim 6 wherein the second arm is open from its end integral with the intermediate member to its free end, the size of the opening adjacent the free end being less than the size of the remainder of the opening so as to form a shoulder within the second arm adjacent its free end, and the means for securely fastening together the first and second arms of adjacent units comprises a first threaded member threaded to the free end of the first arm and extending into the recess in said first arm and into the opening in the second arm of an adjacent unit beyond the shoulder within the second arm and a second threaded member threaded onto the first threaded member so as to bear against the shoulder within the second arm and force the free end of the second arm into intimate contact with the shoulder in the first arm.

8. Stringers formed of units as defined in claim 7 wherein the free end of the second arm is rotatably received within the recessed section of the first arm of adjacent units and the units arranged into a spiral configuration to support a spiral stairway.

9. A stairway constructed of a single stringer as defined in claim 8 wherein the stringer is positioned centrally of the stairway.

10. Stringers formed of units as defined in claim 9 wherein the units are made of a cast material selected from the group consisting of steel, iron, aluminum, bronze, brass and plastic.

* * * * *